United States Patent [19]

Kato et al.

[11] Patent Number: 4,478,508

[45] Date of Patent: Oct. 23, 1984

[54] AUTOMATIC CONTINUOUS MEDIUM SETTING DEVICE

[75] Inventors: Akinori Kato, Kusatsu; Yoshihiro Chujo, Otsu, both of Japan

[73] Assignees: Fujitsu Limited, Kawasaki; Toray Industries, Inc., Tokyo, both of Japan

[21] Appl. No.: 440,561

[22] Filed: Nov. 10, 1982

[30] Foreign Application Priority Data

Nov., 1981 [JP] Japan ..... 56-181835

[51] Int. Cl.[3] ..... G03G 15/00

[52] U.S. Cl. ..... 355/14 R; 355/3 SH; 355/14 SH; 271/152

[58] Field of Search ..... 355/14 R, 14 SH, 3 SH, 355/3 R; 271/4, 6, 226, 227, 152, 153, 154

[56] References Cited

U.S. PATENT DOCUMENTS

| | | | |
|---|---|---|---|
| 4,299,477 | 11/1981 | Ward et al. | 355/14 R |
| 4,300,710 | 11/1981 | DuBois et al. | 355/14 R X |
| 4,320,960 | 3/1982 | Ward et al. | 355/14 R |
| 4,338,020 | 7/1982 | Yukawa et al. | 355/14 SH X |
| 4,341,460 | 7/1982 | Kohyama | 355/3 SH X |

OTHER PUBLICATIONS

IBM Technical Disclosure Bulletin, vol. 18, No. 2, Jul. 1975; pp. 330, 311, New York; W. E. Church et al.: "Dynamic Sheet Length Sensing".

IBM Technical Disclosure Bulletin, vol. 20, No. 8, Jan. 1978; p. 3049, New York; D. F. Manning et al. : "Pivoting Forms Guide".

*Primary Examiner*—A. C. Prescott

*Attorney, Agent, or Firm*—Staas & Halsey

[57] ABSTRACT

An automatic continuous medium setting device includes a delivery means for feeding a continuous medium along a delivery passage, a medium treating means arranged on the delivery passage, a medium accumulating means arranged at the terminal end portion of the delivery passage and a setting means for temporarily setting the continuous medium in a temporary setting position in relation to the medium treating zone, arranged before the medium treating zone on the delivery passage. A medium feed quantity determining means determines the feed quantity of the continuous medium during the delivery when the continuous medium is fed from the temporary position to the accumulating zone. The medium feed quantity determining means being connected to said delivery means.

8 Claims, 5 Drawing Figures

Fig. 3
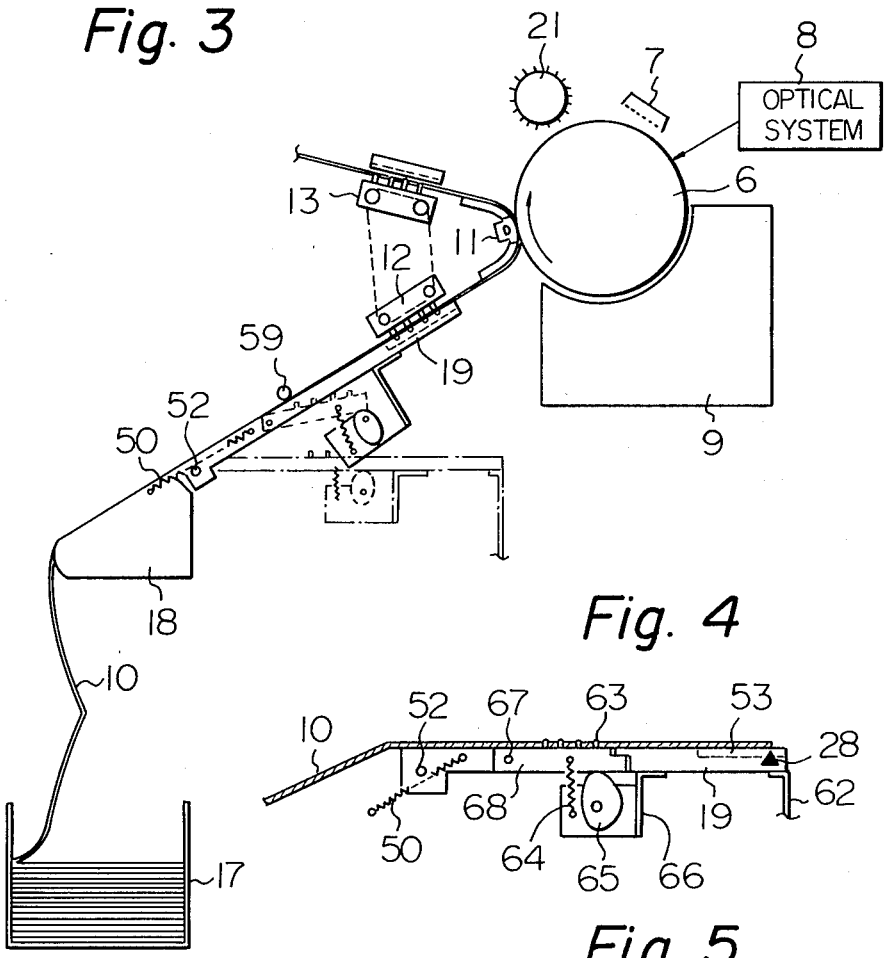
Fig. 4
Fig. 5
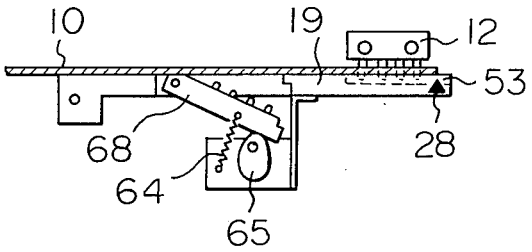

AUTOMATIC CONTINUOUS MEDIUM SETTING DEVICE

BACKGROUND OF THE INVENTION

The present invention relates to a device for setting a printing medium (such as paper or plastic film) in an electrophotographic printing apparatus or the like.

Continuous printing paper for use in a electrophotographic printing apparatus is contained in a paper supply zone in a state where it is folded in pages; the paper is taken out of the paper supply zone, printed, and then stored in an accumulating zone in the folded state. When this continuous paper is first set at the printing apparatus, the top end of the paper is taken out from the paper supply zone, passed through the printing zone and extended to the accumulating zone, thereby completing the setting operation. When the setting operation is complete, the portion of the paper confronting the printing zone should be the top end portion of one page as defined by the fold lines, that is, the paper should be located at the print starting position.

The conventional medium supply mechanism of an electrophotographic apparatus comprises delivery means for feeding a medium (such as continuous folded paper) along a delivery passage, a medium treating zone (such as a printing zone) mounted on the delivery passage, a medium accumulating zone disposed at the terminal end of the delivery passage, and an initial setting zone for temporarily setting the top end of the continuous medium before the medium treating zone on the delivery passage. In this conventional apparatus, the top end of the continuous medium is once set in the initial setting zone, and in order to engage this medium with a delivery means, the medium is fed to the position of the delivery means by an auxiliary driving device. When the medium is delivered by the delivery means and the top end of the medium is guided to the accumulating zone, the delivery operation is stopped, and the printing medium in the printing zone is set at the predetermined printing-starting position by a manual operation performed by an operator or by an intermittent driving of the delivery means. Thus, the operation of setting the printing medium is completed.

However, this setting method is disadvantageous in that the operation of registering the paper with the printing-starting position is very troublesome and a long time is necessary for this operation.

SUMMARY OF THE INVENTION

It is therefore a primary object of the present invention to provide an automatic continuous medium setting device in which the defects of the above-mentioned conventional techniques are eliminated, and when the paper is set in a printing apparatus, the operation of registering the paper in the printing zone is automatically accomplished.

The automatic continuous medium setting device of the present invention comprises the above-mentioned conventional medium supply mechanism and further comprises a medium feed quantity determining means for determining the feed quantity of the medium during the delivery. This is accomplished when the top end of the continuous medium is delivered from the temporary setting position to the accumulating zone and the medium is set at the predetermined position in the medium treating zone, and the medium feed quantity determining means is connected to the delivery means.

The present invention will now be described in detail with reference to embodiments illustrated in the accompanying drawings.

BRIEF DESCRIPTION OF THE DRAWINGS

FIG. 3 is a diagram illustrating the structure of the initial setting zone of the medium setting device of the present invention; and FIGS. 4 and 5 are diagrams illustrating in detail the operation states of the initial setting zone shown in FIG. 3.

DESCRIPTION OF THE PREFERRED EMBODIMENTS

Figure 1:
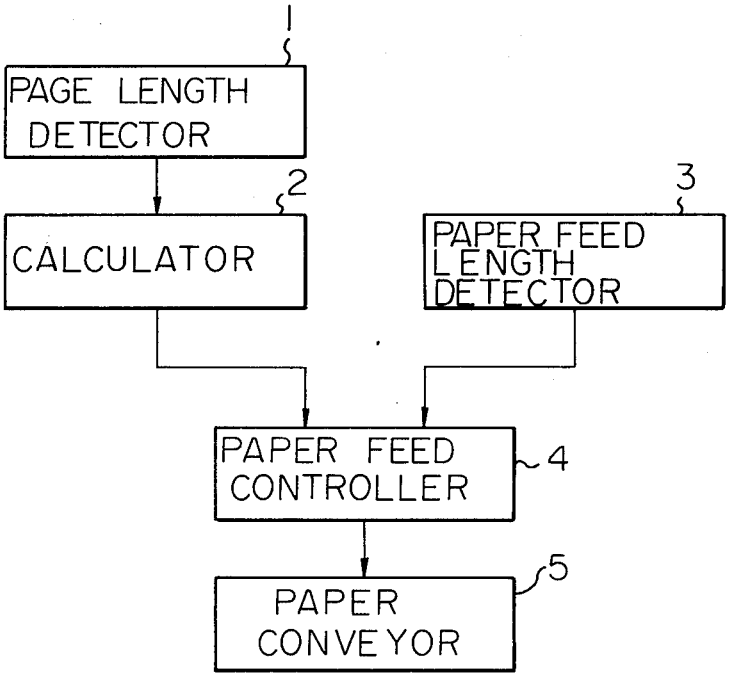
FIG. 1 is a control block diagram of the medium setting device according to the present invention.

The control system of the automatic continuous medium setting device of the present invention will now be described with reference to FIG. 1.

A page length detecting means (page length detector) 1 detects the length of one page corresponding to the fold distance of the paper used in the printing apparatus and provides a length signal to a computing means (calculator) 2.

The computing means 2 computes the paper delivery distance from the temporary setting position to the accumulating zone according to the length signal from the page length detecting means 1, and sends the results of the computation to a paper delivery control means (paper feed controller) 4. After the paper has been set at the temporary setting position, the paper is delivered to the accumulating zone by a delivery means (paper conveyor) 5. The computing means 2 computes the feed quantity of the paper while the top end of the paper is guided to the accumulating zone from the temporary setting position and the paper is set at the predetermined printing position to the printing zone.

A paper delivery length detecting means (paper feel length detector) 3 detects the delivery passage of the paper delivered on the delivery passage and sends a detecting delivery length signal to the paper delivery control means 4.

The paper delivery control means 4 delivers the paper until the length signal from the computing means 2 becomes equal to the delivery length signal from the paper delivery length detecting means 3, and when the signals become equal to each other, the paper delivery control means 4 applies a stop signal to the delivery means 5 to immediately stop delivery of the paper.

By the foregoing operations, the paper is assuredly delivered to the predetermined position and stopped there.

A specific embodiment of the control system of the automatic continuous medium setting device of the present invention will now be described with reference to FIG. 2.

Figure 2:
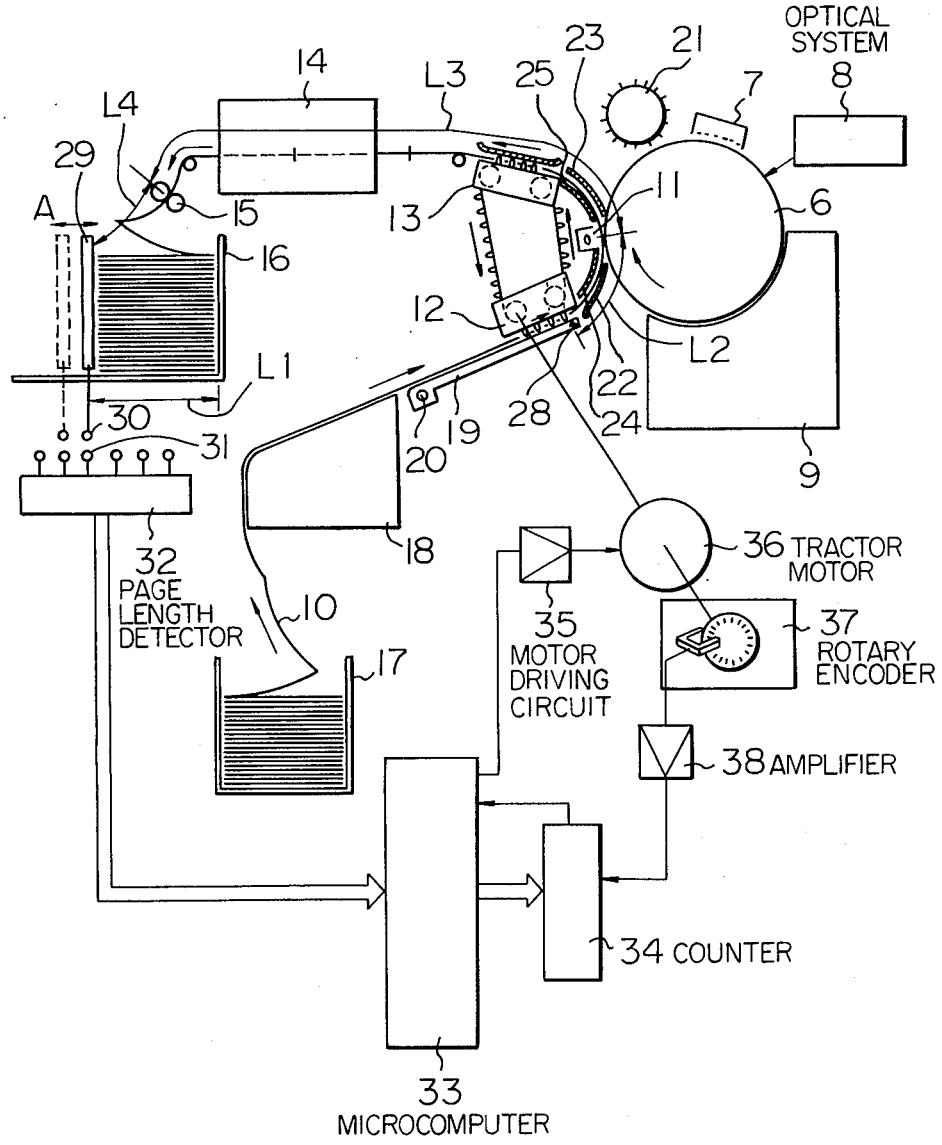
FIG. 2 is a diagram illustrating the structure of the medium setting device according to the present invention.

Referring to FIG. 2, a photoconductor drum 6 is uniformly charged by a charging device 7 and is exposed imagewise according to an image information from an optical system 8. Since the surface electrostatic potential of the photoconductor drum 6 is lowered in the exposed area, the optical image information is converted to an electrostatic pattern.

The electrostatic pattern is developed by a toner supplied by a developing means 9 to form a visible image. A continuous printing paper 10 is delivered to a transfer means 11 at a speed controlled to be the same as the surface speed of the photosensitive drum 6.

The paper 10 is withdrawn in succession from a hopper 17, passed through a paper guide 18 and a paper setting stand 19, and guided to a tractor 12 and the transfer means 11. By the transfer means 11, the visible image on the photoconductor drum 6 is transferred onto the paper 10 and printing is effected on the paper 10. After the transfer operation, the toner left on the photoconductor drum 6 is completely removed by a cleaning brush 21.

The operation of the control system of the automatic continuous medium setting device of the present invention will now be described with reference to FIG. 2.

The paper setting stand 19 turns around a shaft 20 and is pressed against the delivery face of the tractor 12 by the elastic force of a spring (not shown) or the like.

An operator keeps the paper setting stand 19 horizontal and registers the top end of the paper 10 with a mark 28 on the paper setting stand 19 and temporarily fixes the paper 10 to the setting stand 19. Then, the paper setting stand 19 is rotated around the shaft 20, and a delivery hole of the paper 10 is engaged with a delivery projection of the tractor 12. After that, the paper 10 which has been fixed to the setting stand 19 is released. By the foregoing operation, the paper 10 is made deliverable by the tractor 12.

As the method of fixing the paper 10 to the paper setting stand 19, there can be mentioned a method in which the paper 10 is sucked from below the paper setting stand 19 by vacuum and a method in which static charges are generated on the surface of the paper setting stand 19 and the paper 10 is attracted by the electrostatic attracting force.

By driving tractors 12 and 13, the paper 10 engaged with the tractor 12 is pushed in between a transfer guide 24 and an outward turning guide 22, passed through the transfer means (printing zone) 11, then passed between a transfer guide 25 and an outward turning guide 23, and guided to the tractor 13.

The visible image-transferred paper 10 which is being passed while being engaged with a delivery projection of the tractor 13 is fed to a fixing device 14 and the visible image is heat-fixed. Then, the paper is introduced into a scuff roller 15 of such a principle that if the torque exceeds a certain level, a power transmitting zone slips. The paper 10 is pulled under a certain tension by the scuff roller 15 so that the paper 10 is not slackened in the fixing device 14. Then, the paper 10 is fed to a paper receiver (accumulating zone) 16 and is accumulated therein in the folded state.

The paper feed speed during the paper setting operation is slower than the feed speed during the printing operation so as to securely set the paper. After setting the paper, the printing operation is started in normal paper feed speed.

The control system for stopping the paper at the predetermined position at the time of setting the paper in the present embodiment will now be described. As means for setting the fold length of the paper 10, that is, the length of one page, a folding stopper 29 is mounted on a paper receiver 16. The fold stopper 29 is disposed to set the fold length (L1 is the drawings) of the paper in the paper receiver 16. The fold stopper 29 is moved to the left or right according to the size of one page of the paper in the direction of an arrow (A in the drawings) and set at a position corresponding to the fold length of the paper 10. A light projector 30 is attached to the fold stopper 29.

The light projector 30 irradiates light on one of the light-receiving elements 31 of a page-length detector 32 that is located at a position corresponding to the fold length of the paper 10.

The page length detector 32 outputs a signal corresponding to the fold length L1 of the paper 10 according to the position of the irradiated light-receiving element 31, and the length signal from the page-length detector 32 is input to a microcomputer 33. The page length detector 32 may be mounted on the hopper 17 of the paper supply zone. When standardized paper is used, there may be adopted a method in which the operator operates a changeover switch according to the size of the paper used to put out a signal corresponding to the fold length into the microcomputer 33. Furthermore, a mechanical detecting means or Hall IC may be used.

On receipt of the length signal from the page length detector 32, the microcomputer 33 computes a minimum positive integer N satisfying the following requirement:

$$N \geqq (L3+L4)/L1 = L0/L1 \quad (1)$$

(wherein L1 stands for the fold length of the paper 10, L3 stands for the distance between the transfer means 11 and the draw-in roller 15, L4 stands for the distance between the scuff roller 15 and the paper receiver 16 and L0 stand for the distance between the transfer means 11 and the paper receiver 16). The microcomputer 33 delivers the paper 10 by a length M represented by the following formula:

$$M = N \times L1 + L2 \quad (2)$$

(wherein L2 stands for the distance between the mark 28 and the transfer means 11, and N and L1 are as defined above). Then, the paper 10 is stopped at the point where the printing position of the paper 10 is in agreement with the position of the transfer means 11. Namely, the pulse number m corresponding to the value M (for example, if 0.1 mm corresponds to 1 pulse, when the length M is M mm, the pulse number m is 10 M) is preset in a counter 34.

The tractor motor 36 is rotated through a motor driving circuit 35 to drive the tractor 12. A rotary encoder 37 is disposed on the tractor motor 36 to output pulses corresponding to the delivery length of the paper 10. For example, the rotary encoder 37 is set so that when the paper 10 is delivered by 0.1 mm, one pulse is output. Accordingly, when delivery of the paper 10 is started after the setting of the paper 10, the rotary encoder 37 detects the delivery quantity of the paper 10 and outputs a pulse signal.

The pulse signal output from the rotary detector 37 is amplified by an amplifier 38 and input to the counter 34.

The counter 34 output an agreement signal to the microcomputer 33 when the pulse number m preset by the microcomputer 33 becomes equal to the value of the pulse signal from the rotary encoder 37. On receipt of the agreement signal from the counter 34, the microcomputer 33 sends a stop signal to the motor driving circuit 35.

On receipt of the stop signal, the motor driving circuit 35 stops the tractor motor 36 which stops the driving of the tractor 12, whereby the delivery of the paper 10 is stopped.

In the above-mentioned manner, the operation of setting the paper is accomplished in the state where the printing-starting position of the paper is registered with the printing zone.

In the foregoing embodiment, at the time of setting the paper, the position of the top end of the paper is registered with the mark on the paper setting stand. The present invention, however, is not limited to this feature. For example, there may be adopted a modification in which the position of the paper on the paper setting stand is detected by a sensor or the like and the distance between this position and the transfer means is computed. If this modification is adopted, only setting the paper on the paper setting stand without registering it with the mark, the paper can automatically be stopped at the printing-starting position of the printing apparatus without registering the paper with the mark on the paper setting stand, and the setting operation can be simplified.

An example of the paper setting stand 19 for temporarily setting the top end of paper will now be described with reference to FIGS. 3 through 5. The paper setting stand 19 rotates around a shaft 52, and it is pressed to the delivery face of the tractor 12 by the elastic force of a spring 50. In order to provide an appropriate clearance between the delivery face of the tractor 12 and the surface of the paper setting stand 19, a stopper 59 is located at a position outside of the paper delivery passage.

FIG. 4 illustrates the paper setting stand of the present embodiment in detail. In the state shown in FIG. 4, the paper setting stand 19 is kept horizontal and the delivery holes of the paper 10 are engaged with the projections 63. This state is indicated by one-dot chain lines in FIG. 3. A plate 68 having the projections 63 is integrated with the paper setting stand 19. A stopper 62 is disposed to keep the paper setting stand 19 horizontal when the delivery holes of the paper are engaged with the projections 63.

The plate 68 rotates around a shaft 67 attached to the paper setting stand 19 and the plate 68 is urged toward a cam 65 by the elastic force of a spring 64. By rotation of the cam 65 the plate 68, having the projections 63, is rotated. A metal fitting 66 is disposed to support the cam 65.

The operation of the plate 68 is synchronized with the tractor 12 in advance so that the topmost delivery hole of the paper 10 falls into engagement with the delivery projections of the tractor 12. When the paper setting stand 19 is turned to the tractor 12 the paper setting stand 19 has an escape 53 for preventing the stand 19 from colliding with the delivery projection of the tractor 12 when the delivery holes of the paper 10 fall into engagement with the delivery projections of the tractor 12.

The plate 68, having the projections 63, engaged with the delivery holes of the paper 10 is brought down from the level of the surface of the paper setting stand 19 by the elastic force of the spring 64 by causing the cam 65 to make a half turn as shown in FIG. 3, after the delivery projection of the tractor 12 has been brought into engagement with the topmost delivery hole of the paper 10. Accordingly, the projections 63 of the plate 68 are separated from the delivery holes of the paper 10. In other words, the delivery holes of the paper 10 are engaged only with the delivery projections of the tractor 12. If the tractor 12 is driven in this state, the paper can be delivered from the temporary setting position without using any other auxiliary driving device, and setting of the paper can be accomplished assuredly.

We claim:

1. An automatic continuous medium setting device having a delivery passage with a terminal end, comprising:

delivery means for feeding a continuous medium along the delivery passage, the continuous medium having a top end;

a medium treating zone arranged along the delivery passage;

a medium accumulating zone arranged at the terminal end of the delivery passage;

an initial setting zone, for placing the continuous medium in a temporary setting position, disposed before the medium treating zone on the delivery passage; and medium feed quantity determining means for determining the feed quantity of the continuous medium during the delivery when the continuous medium is set at a predetermined position in relation to the medium treating zone and the top end of the continuous medium is then fed from said temporary setting position to the accumulating zone, said medium feed quantity determining means being connected to said delivery means.

2. An automatic continuous medium setting device according to claim 1, wherein:

the continuous medium is folded paper having a top end and is stored, in a folded state in the accumulating zone;

the medium treating zone is a printing zone for printing on the folded paper at a printing position; and a paper feed quantity M, determined by said medium feed quantity determining means, is expressed by the following formula:

$$M=N\times L1+L2$$

where N is a positive integer satisfying the requirement of $N\geqq L0/L1$, where L1 stands for the fold length of the paper, where L2 stands for the distance between the position of the top end of the paper in the initial setting zone and the printing position and where L0 stands for the distance between the printing position and the accumulating zone.

3. An automatic continuous medium setting device according to claim 2, wherein the initial setting zone is provided with an electrostatic attracting means for temporarily fixing the paper.

4. An automatic continuous medium setting device according to claim 2, wherein the paper has guide holes formed therein, said device further comprising: fixing means for temporarily fixing the paper in the initial setting zone, said fixing means having projections which are fitted in said guide holes said projections being able to rise above and sink below the delivery passage.

5. An automatic setting device for setting the position of a continuous medium, having a delivery passage with a first and a terminal end, comprising:

delivery means for feeding the continuous medium along the delivery passage;

treating means, positioned adjacent the delivery passage, for treating the continuous medium;

accumulating means, positioned at the terminal end of the delivery passage, for accumulating the continuous medium;

setting means disposed along the delivery passage at the first end of the delivery passage, for placing the continuous medium in a temporary setting position with respect to said delivery means; and feed quantity determining means, operatively connected to said delivery means, for determining the feed quantity of the continuous medium during the feeding when the continuous medium is set at the temporary setting position and then fed from the temporary setting position to said accumulating means.

6. An automatic setting device according to claim 5, wherein:

the continuous medium is folded paper having a top end which is stored in said accumulating means in a folded state;

said treating means comprises printing means for printing on the folded paper at a printing position; and a paper feed quantity M is determined by said feed quantity determining means and is expressed by the following relation:

$$M = N \times L1 + L2$$

where N is a positive integer satisfying the requirement that $N \geqq L0/L1$, where L1 is a fold length of the paper, where L2 is a distance between the top end of the paper and said printing position when the paper is in the temporary setting position, and where L0 is a distance between the printing position and the accumulating zone.

7. An automatic setting device according to claim 6, wherein said setting means includes an electrostatic attracting means for temporarily fixing the paper.

8. An automatic setting device according to claim 6, wherein the paper has guide holes formed therein, said device further comprising, means operatively connected to said setting means for temporarily fixing said paper, said temporary fixing means having projections which are fitted in the guide holes, said projections being able to rise above and fall below the delivery passage.

* * * * *